United States Patent [19]

Nycz

[11] Patent Number: 4,832,219

[45] Date of Patent: May 23, 1989

[54] DUAL DISPENSING HINGED CLOSURE

[75] Inventor: Joseph D. Nycz, Haskins, Ohio

[73] Assignee: Owens-Illinois Closure Inc., Toledo, Ohio

[21] Appl. No.: 207,467

[22] Filed: Jun. 16, 1988

[51] Int. Cl.[4] ..... B65D 47/00

[52] U.S. Cl. ..... 215/235; 215/313; 220/253; 222/482

[58] Field of Search ..... 215/235, 237, 313; 220/253; 222/481, 482, 483, 486, 487, 546, 548

[56] References Cited

U.S. PATENT DOCUMENTS

| | | | |
|---|---|---|---|
| 2,202,653 | 5/1940 | Glidden | 220/253 X |
| 3,059,816 | 10/1962 | Goldstein | 222/484 X |
| 4,487,324 | 12/1984 | Ostrowsky | 215/235 X |
| 4,548,331 | 10/1985 | Montgomery | 220/253 |
| 4,625,898 | 12/1986 | Hazard | 215/235 X |
| 4,638,916 | 1/1987 | Beck et al. | 222/517 X |
| 4,699,299 | 10/1987 | Gach | 222/482 X |
| 4,723,669 | 2/1988 | Barriac | 215/235 X |

*Primary Examiner*—Donald F. Norton

[57] ABSTRACT

A snap hinge dispensing closure has dual dispensing capability for dispensing large or small quantities of content from a container on which it is used. The hinged cover cap when opened exposes a large orifice dispensing spout on the body of the closure, and when closed the large orifice connects with a small orifice in the cover cap. The small orifice is controlled by a rotary disc mounted on the cover cap which includes a spout that registers with the small orifice for dispensing smaller quantities, or is set out of registry to close the small orifice. Upon opening the cover cap about the hinge, the large orifice is accessible to dispense larger quantites of content from the container.

13 Claims, 2 Drawing Sheets

DUAL DISPENSING HINGED CLOSURE

FIELD OF THE INVENTION

The invention relates to plastic dispensing closures for containers having a hinged cap joined to the closure body by an integrally molded hinge, and more particularly to closures having multiple dispenser openings for dispensing product from the container at different rates.

BACKGROUND OF THE INVENTION

Known plastic dispensing closures include a closure body that is secured to the neck of a container by threading the body onto the neck finish threads of the container. A cover cap is molded with the body and attached by a snap hinge such that the cap is pivoted between an open position for discharging product from the container and a closed position closing the discharge outlet. The hinge is integrally molded from the polymeric plastic of the closure and cap and enables the cap to be pivoted relative to the closure by simple hand manipulation of the user. Typical snap-hinged dispensing closures are disclosed in U.S. Pat. Nos. 4,638,916, 4,625,898 and 4,487,324.

Other dispensing closures include multiple orifices which dispense product when the cover cap is opened, such as disclosed by U.S. Pat. No. 3,059,816.

SUMMARY OF THE INVENTION

Among the objects of the present invention are to provide a dispensing closure for a container which will allow the user an option of dispensing either small quantities of product or larger quantities using the same closure; which allows dispensing small quantities with the cover cap closed and large quantities with the cover cap opened; and which is relatively easy and economical to manufacture.

In accordance with the invention, the closure with a hinged cover cap, such as a snap hinged cover cap, comprises a closure body that is adapted to interengage with the open neck of the container, a cover cap and an integral hinge interconnecting the body and cap. The body and cap each comprise a top wall and peripheral skirt. The top wall of the closure body includes either an out-turned spout or aperture defining an orifice for dispensing product, this orifice being of a larger dimension for dispensing large quantities of product. The cover cap includes a smaller orifice in its top wall which lies over the larger orifice of the closure body when the cover cap is closed. The two orifices communicate in the closed position of the closure and cap to enable dispensing the smaller amounts of the product when desired. The small orifice in the cover cap is controlled by a rotatable disc having a pouring spout that may be positioned in alignment or out of alignment with the orifice. With the cover cap closed and the spout aligned with the orifice, small quantities of product may be dispensed from the container with the cover cap closed; and by rotating the disc to misalign it with the orifice in the closed cover cap closes the container and seals it against dispensing product and contamination. Opening the cover cap allows direct dispensing through the larger orifice of larger amounts of the product whenever that is desired. The product flow through the larger orifice whenever dispensing is through the smaller orifice which keeps the product confined and in so doing does not allow product to flow into unwanted areas. The construction allows for better control over the dispensing of product.

Included in the construction of the invention is a provision for a tight seal and spout cleansing in a closure that is used in a product dispenser. The body includes an axial spout extending outwardly from the top wall. The end of the spout is chamfered inwardly and the cover cap also has a circular wall depending downwardly on the underside of its top wall arranged concentrically with the open end of the spout when the cover cap is closed. The circular wall is chamfered to be received internally of the spout to align and seal the wall at the rim of the spout when the cover cap is closed. This provides a seal of the larger orifice and cleansing of the spout each time the cap is closed.

For a further understanding of the invention and the objects thereof, reference is made to the drawings and the description thereof, to the detailed description of the invention and to the appended claims.

DETAILED DESCRIPTION OF THE INVENTION

Figure 1:
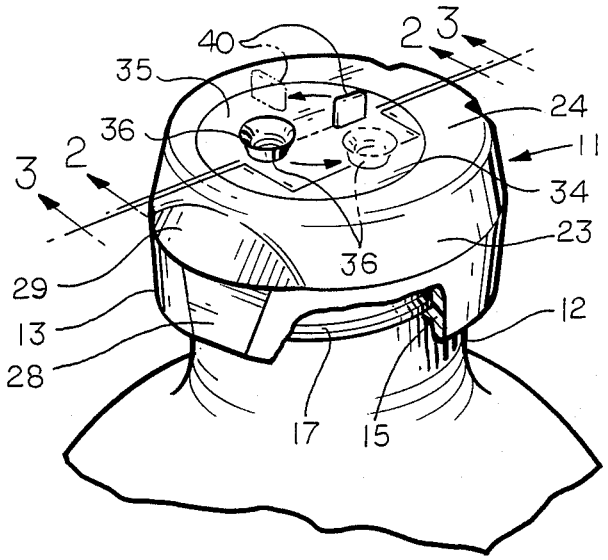
FIG. 1 is a front perspective view of the dispensing closure of the present invention on a bottle with a portion of the closure skirt broken away.
Figure 2:
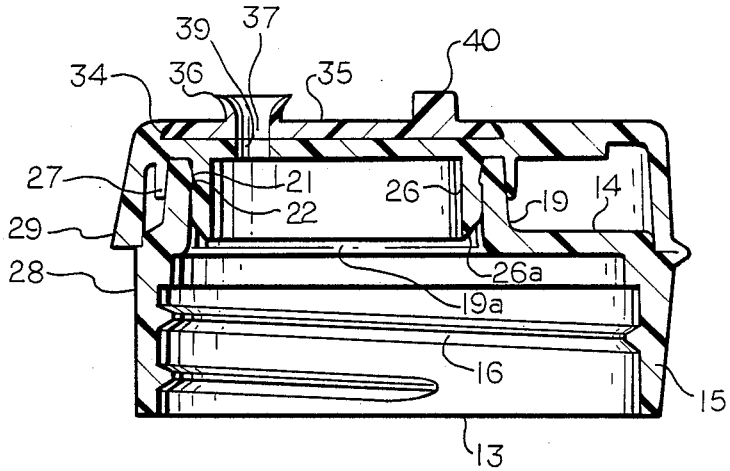
FIG. 2 is a sectional elevational view of the dispensing closure body, hinge and cover cap taken along line 2—2 on FIG. 1, showing the small orifice in open position.
Figure 4:
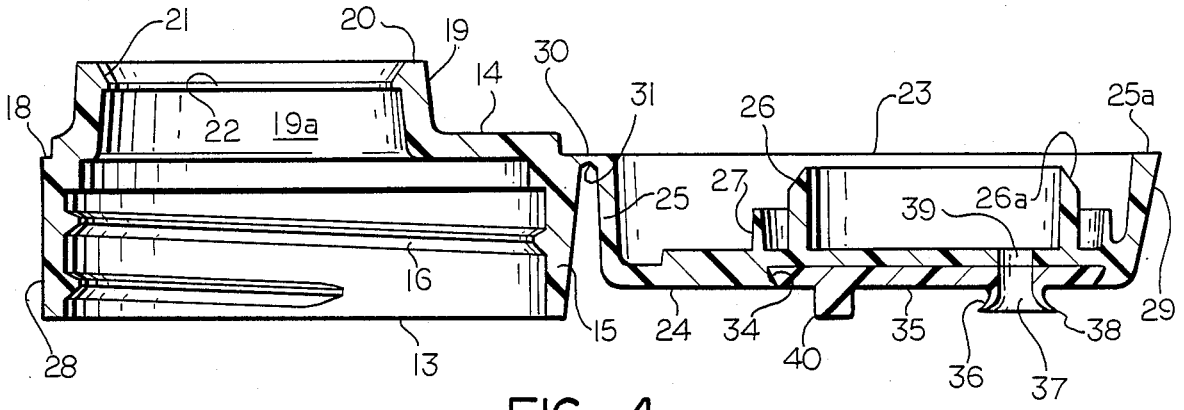
FIG. 4 is a sectional elevational view taken along line 4—4 on FIG. 5, showing the cover cap fully open and the large orifice in open position.

As is shown in FIG. 1, a dispensing closure in accordance with the present invention, indicated generally by reference numeral 11, is shown on the neck 12 of a container. Closure 11 is molded of a plastic material, such as polypropylene, and comprises a closure body 13 comprised of a top wall 14 and downwardly depending annular skirt 15. Internal threads 16 are molded on the skirt 15, which are engaged with corresponding threads 17 on the exterior of the circular neck 12 of the container. Referring to FIGS. 2 and 4, the skirt 15 and top wall 14 of the closure body are joined and provide an annular shoulder 18. A tubular spout 19 extends from the exterior of the top wall 14 and terminates at a circular rim 20 that includes a chamfer 21 and interior bead 22. The rim 20 defines a major or large orifice **19*a* connected to the interior of the container through the spout 19** and provides a major dispensing outlet for larger quantities of the product in the container on which the closure is applied.

A cover cap 23 is molded integrally with body 13 and includes a top wall 24 and peripheral skirt 25. The shoulder 18 is engageable with the free edge **25*a* of skirt 25 when the cover cap is in a closed position. A circular wall 26 provided on the inner surface of top wall 24 is adapted to fit inside spout 19. A second concentric circular wall 27 on the inner surface of the top wall is spaced from wall 26 and is adapted to telescope over spout 19 and encircle its rim 20, the rim being received in the annular cavity between walls 26 and 27 when cap 23 is closed. Wall 27 is axially shorter than wall 26 to permit the cap 23 to swing into and out of closed position on spout 19. The chamfered rim 21 guides wall 26 by its chamfer 26***a* into the opening of spout 19. The inner diameter of outer wall 27 is slightly less than the outer diameter of spout 19 near the rim 20 such that the wall 27 engages and seals along the outside surface of the spout. The rib 22 provides a friction fit for inner wall 26 to insure a good seal for contents of the container, e.g. a liquid, and cleans the spout of the material poured through the orifice in the rim area. The friction fit also secures the cover cap on the closure body in a closed position.

Figure 5:
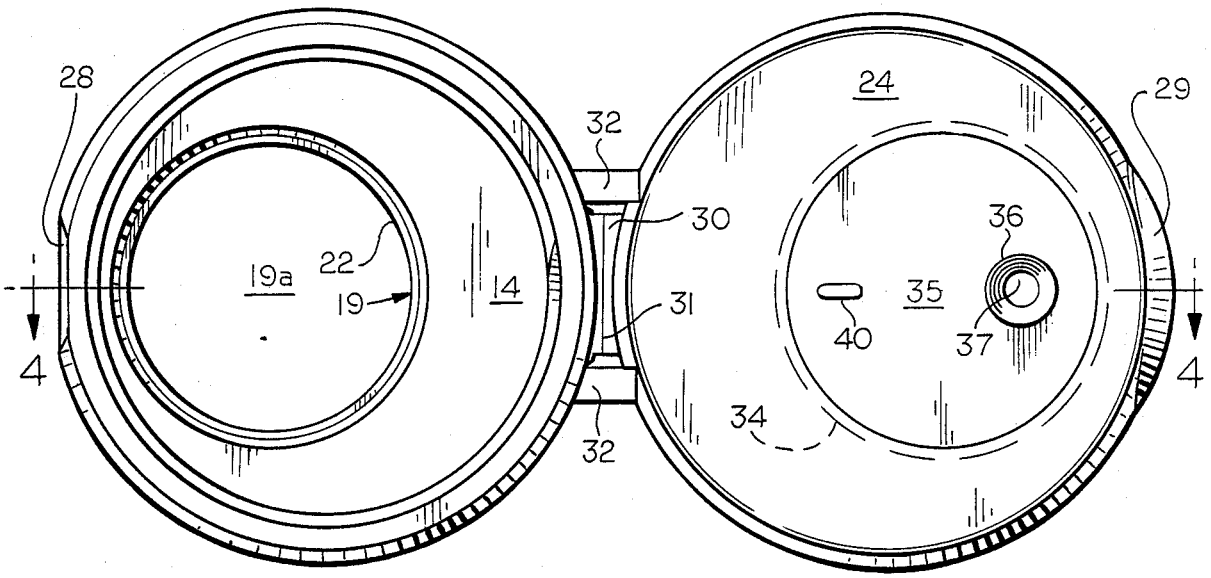
FIG. 5 is a bottom plan view of the dispensing closure of FIG. 2, looking at the closure from the container side and showing the cover cap open.

The front area on the exterior of the skirt 15 of the body 13 has a flattened surface 28 that underlies a radial extension portion 29 of the cover cap skirt 25. The portion 29 may be engaged by the thumb or finger of the user to open the closure and lift cover cap 23 to its open position, shown on FIGS. 4 and 5. An integral hinge 30 has its upper surface in the plane of shoulder 18 of the closure body and the free edge of the skirt 25 of the cover cap. The hinging action is about the v-section of hinge 30 at its apex line 31 (FIG. 4). A pair of hinge straps 32 is provided, one on each side of hinge 30, the length of the hinge 30 being wider than each of the straps 32. The straps 32 extend between the perimeter surface of skirt 15 of the closure body and skirt 25 of the cover cap. The straps 32 are proportioned so they stretch in operation during both opening and closing the cover cap 23 on the body 13 and provide a snap hinge action with the characteristics of a "live hinge" for the closure's cap.

In the top wall 24 of the cover cap, there is a circular undercut surface 34 which provides a circular race or groove for assembling the disc 35 having a complementary sloped perimeter surface. Disc 25 includes an axial spout 36 molded with it, the spout defining a small orifice or opening 37 that is flared outwardly to a relatively sharp annular pouring lip 38. A corresponding aperture 39 is formed through top wall 24 of the cover cap and is positioned on the diameter of the cover including the rotational center of disc 35. On FIGS. 2 and 4, apertures 39 and 37 are shown in an aligned position to provide a pouring spout for small quantities of the container's content while the cover cap is closed, as is shown on FIG. 2. The disc 35 may be rotated in the race 34 of the cover cap by engaging the upstanding lug 40, or any suitable means on the disc by which to rotate it so that orifice 37 and aperture 39 are out of alignment, thereby closing the orifice 37 and breaking the connection between it and the aperture 39 through the cover cap's top wall (dotted outline on FIG. 1, and see FIG. 3.) Marked indicia on the disc and adjacent outer surface (not shown) of the cover cap may be provided to indicate to the user when the opening 39 and orifice 37 are aligned to enable pouring or dispensing small quantities with the cover cap closed.

Figure 3:
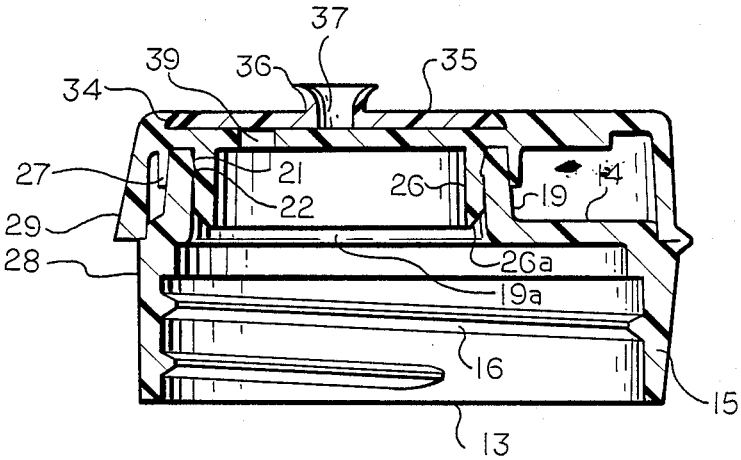
FIG. 3 is a sectional elevational view of the dispensing closure of FIG. 2 taken along line 3—3 on FIG. 1 on which the cover cap is closed on the closed body, and the small orifice is set to a closed position.

The closed position of the closure on the container is shown on FIG. 3 in which the large orifice is closed by circular walls 26 and 27 of the closed cover cap encircling the rim 20 of spout 19 and disc 35 is positioned rotationally to disconnect the aperture 39 from the small spout 37. As such, the package is closed for storage or shipment.

The preferred embodiment of the invention is illustrated and disclosed in connection with a snap hinge style of dispensing closure, however, any form of dispensing closure for adaptation to the neck of the container may utilize the invention in which a hinged cover cap is used on a body closure secured to the container finish.

The basic operation of the closure is designed to work in one of two modes. First, by opening the cover cap on the closure, the large orifice is exposed for dispensing the product in large quantity. Second, by closing the cover cap on the top of the closure body, the disc may be positioned to allow dispensing of product at a slower rate. This will allow the user to easily dispense a small quantity of the product. After dispensing with the orifices aligned and with the cover cap closed, the small orifice can be closed by rotating the disc to a position in which the cover cap aperture and spout orifice no longer are aligned, that is, the small orifice is closed.

The dispensing closure illustrated in the drawings utilizes the concepts or principles of the invention set forth in the appended claims. Those familiar with the art of manufacturing and utilizing dispensing closures will appreciate these concepts can be employed in a variety of closures which differ from the closure illustrated herein as to matters within the scope of ordinary engineering skill in the field.

I claim:

1. A hinged dispensing closure comprising a body closure adapted to interengage with the open neck of a container, a cover cap, each of said body and cover having a top wall and integral peripheral skirt, an integral hinge interconnecting the body closure and cover cap near the periphery of their skirts for pivoting the cover cap between an open position and a closed position over the top wall of the body closure, a large orifice in the top wall of said body for dispensing larger quantities therethrough, an aperture in the top wall of said cover, and a movable member mounted on the top wall of said cover, said member including a small orifice, said member being movable on said top wall between positions connecting said aperture and small orifice and disconnecting them for respectively opening and closing the small orifice for dispensing smaller quantities therethrough.

2. The hinged closure of claim 1 wherein said member comprises a disc rotatably mounted on the top wall of said cover cap.

3. The hinged closure of claim 2 wherein the disc member is mounted flush with the outer top surface of said top wall.

4. The hinged closure of claim 2 wherein the top wall of the cover cap is undercut to provide a circular sloping bearing surface mounting the disc member for rotational movement whereby the small orifice is movable into and out of registry with said aperture.

5. The hinged closure of claim 2 wherein said disc member includes a lug member projecting outwardly therefrom for moving the disc member in opening and closing the small orifice.

6. The hinged closure of claim 5 wherein the disc member includes an integral spout projecting outwardly therefrom and defining said small orifice when aligned with the said aperture in the top wall of the cover cap.

7. The hinged closure of claim 1 including hinge strap means connected between the base closure skirt and the cover cap skirt and proportioned to stretch during movement of the cover cap between open and closed positions about the hinge to provide a snap hinge for said cover on said body.

8. The hinged closure of claim 7 in which said integral hinge has a flat top surface and an inverted v-shaped bottom surface.

9. The hinged closure of claim 7 wherein the hinge strap means comprises a pair of hinge straps disposed on opposite sides of said integral hinge.

10. A dispensing closure comprising a body closure adapted to interengage with the open neck of a container, a cover cap adapted to open and close the body closure, each of said body and cover having a top wall and integral peripheral skirt, a large orifice in the top wall of said body for dispensing larger quantities therethrough, an aperture in the top wall of said cover, and a movable member mounted on the top wall of said cover, said member including a small orifice, said member being movable on said top wall between positions aligning said aperture and small orifice and disaligning them for respectively opening and closing the small orifice for dispensing smaller quantities therethrough.

11. The dispensing closure of claim 10 wherein said member comprises a disc rotatably mounted on the top wall of said cover cap.

12. The dispensing closure of claim 11 wherein the disc member is mounted flush with the outer top surface of said top wall.

13. The dispensing closure of claim 11 wherein the top wall of the cover cap is undercut to provide a circular bearing surface mounting the disc member for rotational movement thereon whereby the small orifice is movable into and out of alignment with said aperture.

* * * * *